US005951010A

United States Patent [19]

Ordinas

[11] Patent Number: 5,951,010

[45] Date of Patent: Sep. 14, 1999

[54] TABLE GAME

[76] Inventor: Jaime Ordinas, Avenida Carlos I, 5, San Sebastian, Spain, E-20011

[21] Appl. No.: 08/981,627

[22] PCT Filed: Apr. 14, 1997

[86] PCT No.: PCT/ES97/00090

§ 371 Date: Dec. 12, 1997

§ 102(e) Date: Dec. 12, 1997

[87] PCT Pub. No.: WO97/38767

PCT Pub. Date: Oct. 23, 1997

[30] Foreign Application Priority Data

Apr. 15, 1996 [ES] Spain ..... 9600847

[51] Int. Cl.[6] ..... A63F 3/00

[52] U.S. Cl. ..... 273/241

[58] Field of Search ..... 273/241, 236, 273/242, 243, 248, 249

[56] References Cited

U.S. PATENT DOCUMENTS

| | | | |
|---|---|---|---|
| 3,030,112 | 4/1962 | Scharp | 273/241 |
| 4,477,080 | 10/1984 | Baker | 273/241 |
| 4,666,162 | 5/1987 | Campbell | 273/241 X |
| 4,993,718 | 2/1991 | Dandridge et al. . | |
| 5,004,245 | 4/1991 | Schumacher et al. | 273/241 |
| 5,102,144 | 4/1992 | Dickerman | 273/241 |

FOREIGN PATENT DOCUMENTS

| | | |
|---|---|---|
| 8710483 | 12/1987 | Germany . |
| 8726392 | 3/1988 | Germany . |
| 2 144 046 | 2/1985 | United Kingdom . |
| 2 228 422 | 8/1990 | United Kingdom . |
| 2 274 250 | 7/1994 | United Kingdom . |

*Primary Examiner*—William E. Stoll

*Attorney, Agent, or Firm*—Wenderoth, Lind & Ponack, L.L.P.

[57] ABSTRACT

A new table game of the question type is provided. The table game is comprised of a game board shaped like a truncated pyramid in the style of Babylonian or ziggurat temples. The board is provided at its sides with steps of which the size diminishes progressively and which determine the degrees of difficulty of the game so that the ascension of the steps by a token, as a result of the correct answers to the themes of the question cards, enables the players team to reach the last step of the pyramid and therefore win the game. The game also comprises a die, a sand timepiece, the game tokens, the question cards, and a display stand-card holder.

6 Claims, 4 Drawing Sheets

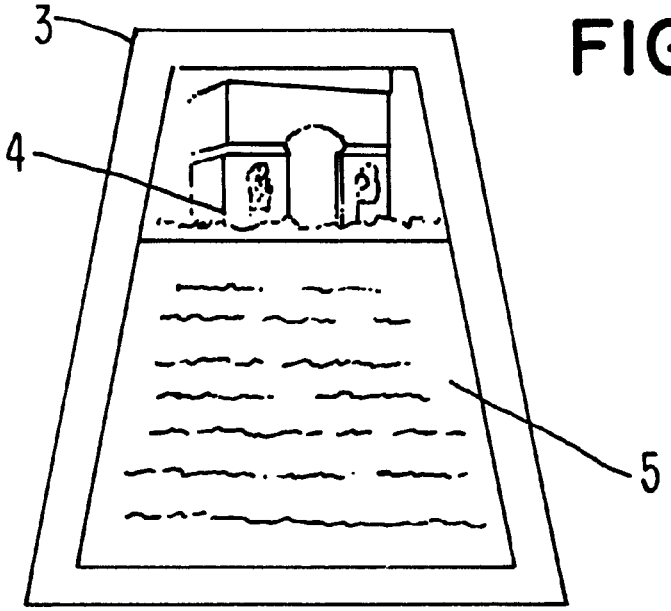
FIG. 5a
FIG. 5b
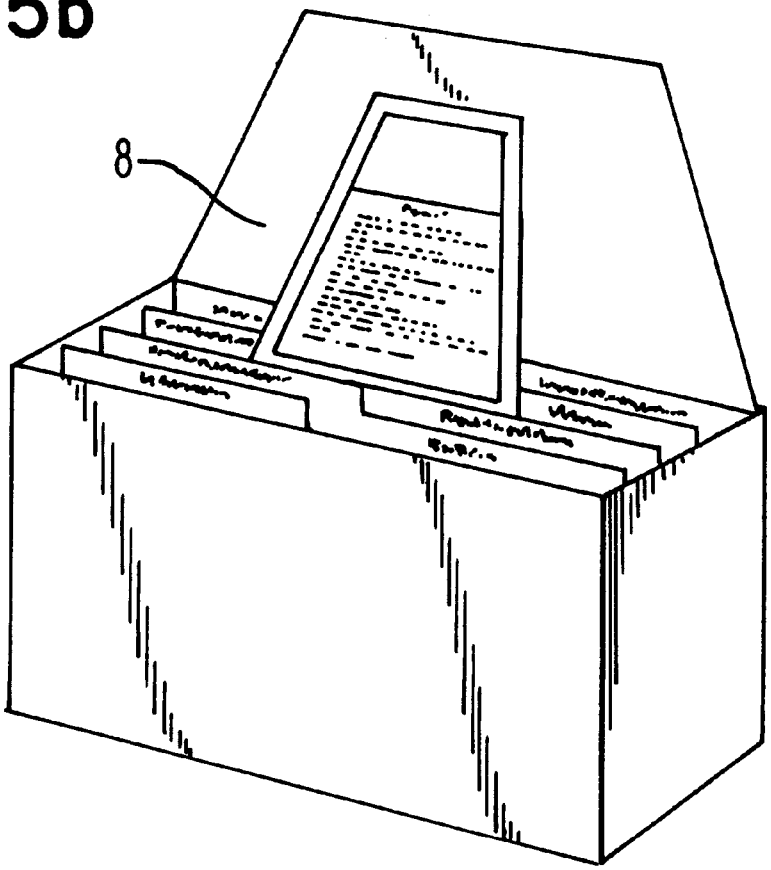

TABLE GAME

BACKGROUND OF THE INVENTION

This invention relates to a new table game, comprising a question-and-answer type board game based on a board in the shape of a truncated, stepped pyramid, like the ancient Babylonian temple towers or ziggurats.

Most existing games are composed of flat boards on which the squares are arranged, whereas the invention described herein includes a board with volume (depth), and other different pieces that afford the game a highly novel character.

Furthermore, all the accessory question cards supplied with games of this kind normally bear only text. However, those of the new game of the present invention include drawings and photographs.

SUMMARY OF THE INVENTION

This Invention constitutes a true innovation and is therefore intended to protect not only the rules of the game but also its different makeup, comprising a particular type of board and a new way of playing on account of its special characteristics, layout and/or combination which constitute a table game in which the squares are arranged on a Babylonian temple tower or ziggurat.

The new table game that constitutes this invention is mainly characterised by its truncated pyramidal structure having three different strips on each of its four sides. The middle strip incorporates steps which diminish in size the nearer they are to the top. The top consists of a flat surface that is shorter than the base of the pyramid.

On the upper surface is another piece which forms part of the board and consists of a Babylonian-style shrine topped with a pinnacle. Both the shrine and the pinnacle can be dismantled and separated from the main body of the pyramid. The new table game that constitutes this invention is also built in such a way as to enable the two aforementioned pieces—the shrine and pinnacle—to be inserted into the pyramid structure through the top, so that the game occupies as little space as possible. The main structure is open at the top and the parts of the shrine are fed into it pointing downwards.

The side steps of the main body of the pyramid structure provide the board's steps or stages of play and enable the rules of the game to vary relative to traditional ones as they are based on stages. Each step or stage marks a level of difficulty in play, and the new table game is based on moving up step by step until the top of the pyramid is reached. The different levels of difficulty are marked with numbers and the name given to this level of difficulty is indicated.

Four figures or pawns in the form of a "Mesopotamian High Priest" in different colours, an hourglass, a die, a display stand and card holder and the corresponding question cards complete the new table game.

The board of the new table game is built in such a way as to house in the interior of the truncated pyramid, which is hollow, all the aforementioned accessories of the game.

BRIEF DESCRIPTION OF THE DRAWINGS

The following sections contain a detailed description of the new table game that constitutes this invention and of the pieces which comprise it, with reference to the accompanying drawings which display, by way of a non-limiting example, a specific version of the invention.

FIGS. 5*a* and 5*b* are views of the display stand and card holder and one of the sides of one of the question cards included in the game.

DETAILED DESCRIPTION OF THE INVENTION

Figure 1:
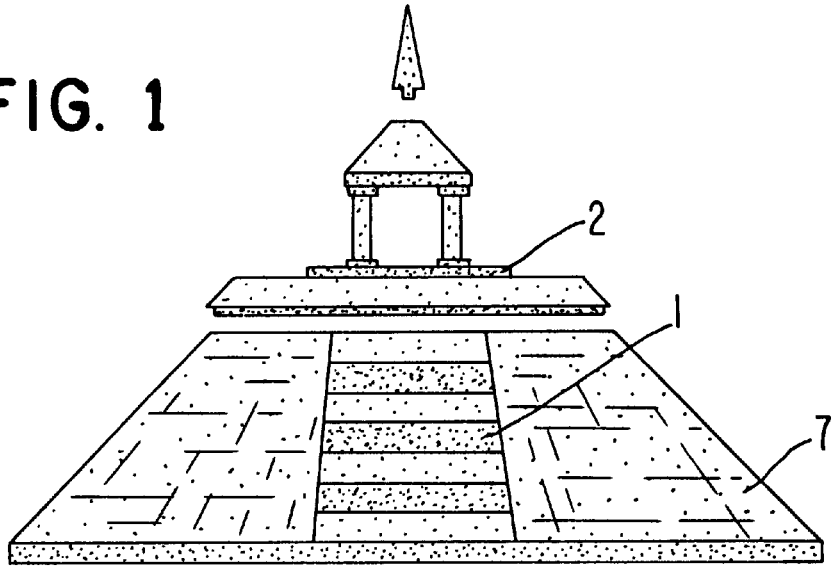
FIG. 1 shows a side view of the board used in the new table game, including the sections which comprise it.
Figure 2:
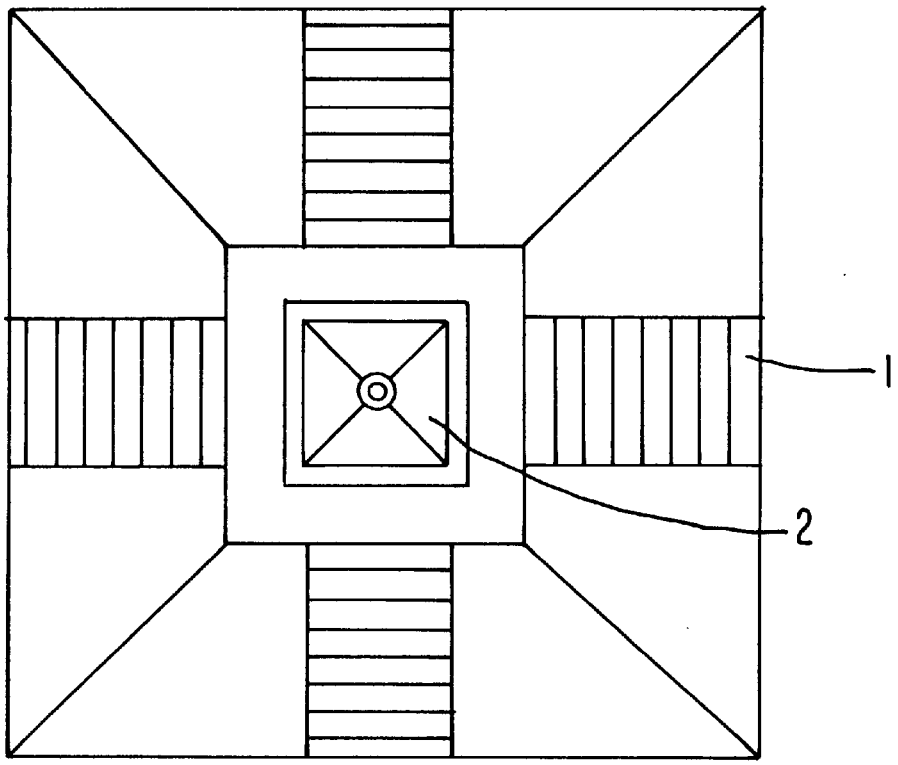
FIG. 2 is a plan view showing the board viewed from above.

The organization and mechanics of the game, with reference to the accompanying drawings, are as follows:

Each of the sides of the truncated pyramid (FIG. 1) is made up of three parts. The middle part contains steps or stages (1) which determine the levels of difficulty of the game which, in this specific version of the invention are: Apprenticeship, Cognisance, Reasoning, Abstraction, Deduction, Revelation, Wisdom, and at the top of the pyramid is the "Shrine of Great Knowledge" (2). The purpose of the game is to complete each of the stages (1) of knowledge, in order to arrive at the "Shrine of Great Knowledge" (2) and be proclaimed "Supreme High Priest". In order to climb to the top and win the game it is necessary to answer correctly the questions contained in the question cards.

The order of play of the teams is determined at the beginning of the game by means of the die included in the game. This order will be maintained throughout the game.

Figure 4:
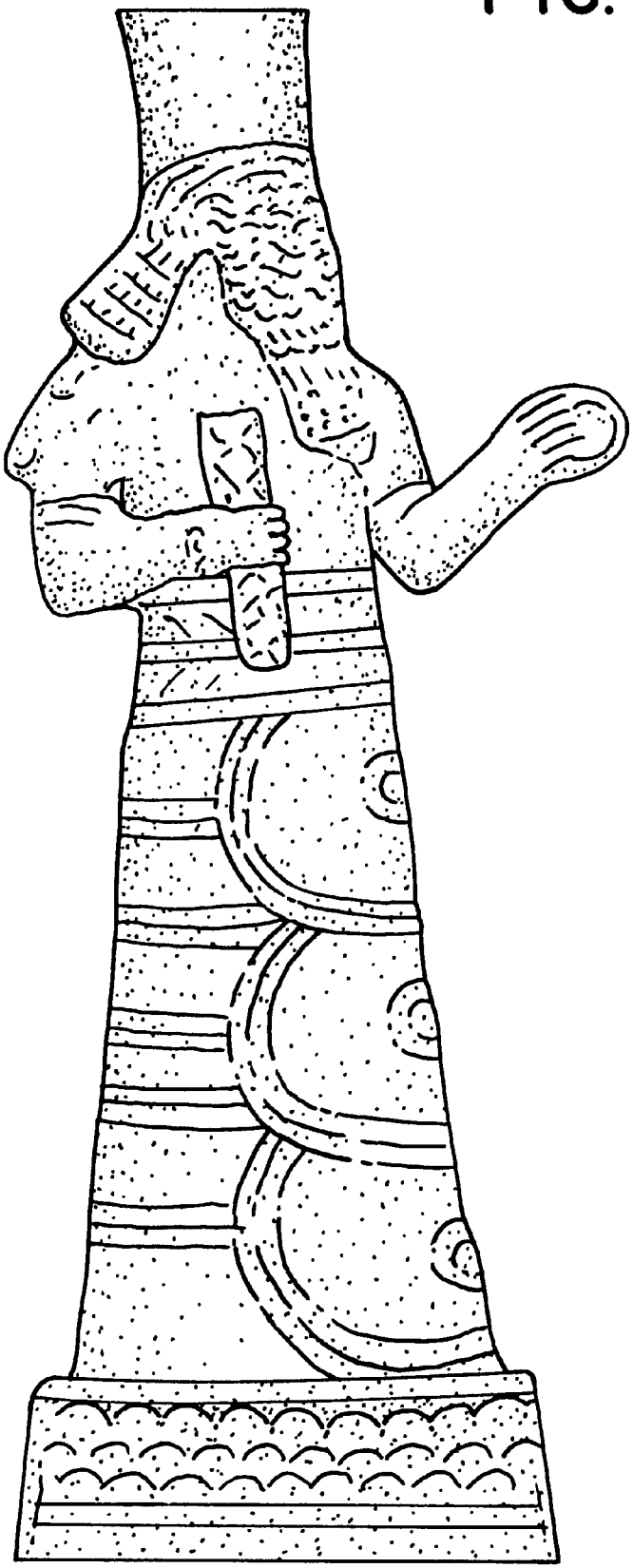
FIG. 4 is a view of the pawn in the form of "Mesopotamian High Priest".

After the order of play has been established, the players place their pawns of chosen colour (FIG. 4) on the first step of the pyramid. The team on the left, called the "referee team", then takes from the display stand-card holder (FIG. 5.*b*) a card (FIG. 5.*a*) corresponding to the first level of difficulty. The cards contain questions on different topics and bear a different topic on each side indicated by means of a letter (3) and a colour. The cards are composed of a drawing or photograph relating to the question topic (4) and a text with information on the question topic (5).

The referee team places the chosen question in the card stand (FIG. 5.*b*), and turns the hourglass over. The team whose turn it is then begins to ask the referee team questions about the topic, trying to guess what it is. The referee team replies with a simple "yes" or "no", basing its answers both on its knowledge and on the information given on the card.

If the team whose turn it is answers the question correctly before the time determined by the hourglass runs out, it moves up a step or level of difficulty and will continue to play. If, however, it gives an incorrect answer, it moves down a step and loses its turn, which is passed on to the next team.

If the team whose turn it is has not given any answer at all before the hourglass runs out, it is given a second chance and this time is obliged to answer within the time granted. If it answers correctly this time, it moves up a step but loses its turn. If it gives an incorrect answer it moves down a step and loses its turn, which is passed on to the following team.

When a turn is passed on to another team, this team is allowed to ask just one question on the subject. If it answers correctly, it moves up a step and continues to play; if it answers incorrectly it moves down a step and loses its turn, which is passed on to the next team. If it fails to give an answer it keeps its turn but the extra turn is passed on to the next team, which is given the same option.

Figure 3:
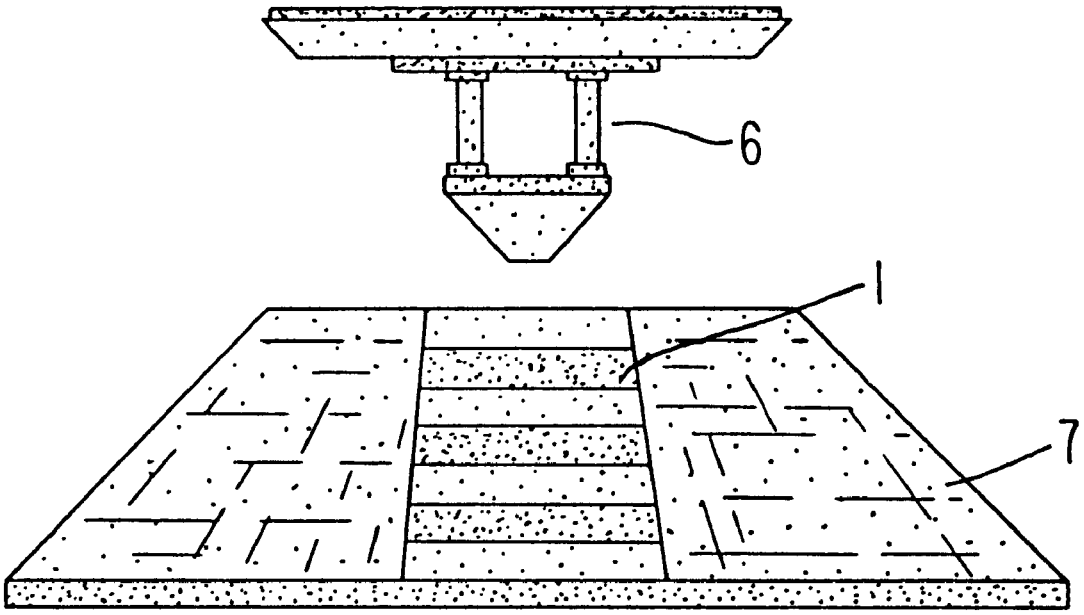
FIG. 3 is a side view showing the body of the pyramid and the upper shrine with one fitted inside the other.

When the game is over, it can be stored so as to occupy the least possible space by placing the shrine (6) inside the pyramid (7) (FIG. 3) and fitting the rest of the pieces into the lower part of the pyramid which is hollow inside.

On the display stand and card holder (FIG. 5.*b*) the cards relating to the different levels of difficulty are separated by cards which are taller than the rest and are the same colour as the level of difficulty to which they correspond. The card holder has an additional element in the same shape as the cards but larger in size (8) which, when incorporated into the box, constitutes the stand on which the cards selected for play are placed.

The materials and sizes of this invention may vary as may, in general, all accessory and secondary features, provided that they do not change or modify the essence of the details described.

I claim:

1. A new table game comprising a board in the shape of a truncated pyramid having steps on each side, the steps determining different levels of difficulty of the game, wherein both the top and bottom of the board are open so that pieces of the new table game may be placed inside the board.

2. The table game of claim 1, further comprising a shrine structure on the top of the pyramid, wherein the shrine structure can be fitted inside the body of the pyramid simply by turning the top of the pyramid upside down.

3. The table game of claim 2, further comprising question cards having two different sides, each of the question cards bearing a different question topic on each side and incorporating text relating to an object, place or person to be described and a picture thereof.

4. The table game of claim 1, further comprising the following accessory elements: four "Mesopotamian High Priest" pawns, an hourglass, a die, a display stand and card holder and corresponding question cards, wherein the accessory elements can be stored in the lower part of the pyramid, the pyramid being equipped for this purpose.

5. The table game of claim 3, further comprising question cards having two different sides, each of the question cards bearing a different question topic on each side and incorporating text relating to an object, place or person to be described and a picture thereof.

6. The table game of claim 1, further comprising question cards having two different sides, each of the question cards bearing a different question topic on each side and incorporating text relating to an object, place or person to be described and a picture thereof.

* * * * *